United States Patent [19]

Gardner

[11] 4,062,447

[45] Dec. 13, 1977

[54] REEL PACKAGE

[75] Inventor: Jeffrey M. Gardner, Wheaton, Ill.

[73] Assignee: Container Corporation of America, Chicago, Ill.

[21] Appl. No.: 720,884

[22] Filed: Sept. 7, 1976

[51] Int. Cl.[2] ..... B65D 85/675

[52] U.S. Cl. ..... 206/396; 206/482; 206/493; 224/45 G

[58] Field of Search ..... 224/45 K, 45 P, 45 R, 224/48 F, 45 G; 206/303, 310, 387, 408, 396, 444, 482, 493, 499, 392, 387; 229/16 R

[56] References Cited

U.S. PATENT DOCUMENTS

| | | | |
|---|---|---|---|
| 1,852,922 | 4/1932 | Driver | 206/482 |
| 2,600,023 | 6/1952 | Rice | 206/310 |
| 2,699,866 | 1/1955 | Russell, Jr. | 206/392 |

FOREIGN PATENT DOCUMENTS

| | | | |
|---|---|---|---|
| 1,246,572 | 10/1960 | France | 206/396 |

*Primary Examiner*—Albert J. Makay
*Assistant Examiner*—Kenneth Noland
*Attorney, Agent, or Firm*—Carpenter & Ostis

[57] ABSTRACT

A package for holding and shipping reels, rolls, spools or the like, comprising an outer container and a plurality of retaining pads disposed adjacent respective reels for preventing lateral movement thereof within the outer container.

1 Claim, 5 Drawing Figures

REEL PACKAGE

SUMMARY OF THE INVENTION

The invention relates to a composite package for holding cylindrical objects such as reels of computer tape or similar objects, which package includes an outer container and a plurality of inner retaining pads for holding the packaged reels in place and for preventing them from shifting laterally in the container.

It is an object of the invention to provide, in a package of the type described, retaining pads having means for positive, snug engagement with the packaged articles to prevent their lateral movement.

A more specific object of the invention is to provide retaining pads for reels with central openings, which pads include a pair of L-shaped retaining elements arranged with overlapping portions which form a hub-like retaining member snugly received within the central opening of a packaged article.

These and other objects of the invention will be apparent from an examination of the following description and drawings.

THE DRAWINGS

It will be understood that, for purposes of clarity, certain elements of the invention may have been intentionally omitted from certain views where they are believed to be illustrated to better advantage in other views.

THE DESCRIPTION

Figure 1:
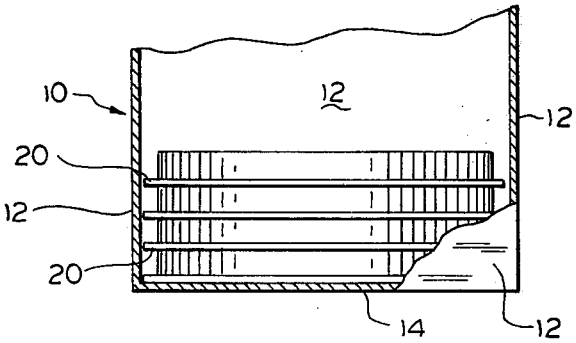
FIG. 1 is a fragmentary side elevation of a composite package embodying features of the invention, with portions of the outer container broken away.

Referring now to the drawing and particularly to FIG. 1, it will be seen that the invention includes a composite package for holding a plurality of reels or similar flat, cylindrical objects indicated at R, adapted to hold computer tape T or other material. The reels each have a cylindrical core indicated at C which defines a central opening O. The reels are arranged in a stack or row within an outer container, indicated generally at 10, which includes a plurality of side walls 12 and an opposed pair of end walls 14 which are foldably joined together to form a box-like enclosure.

Figure 5:
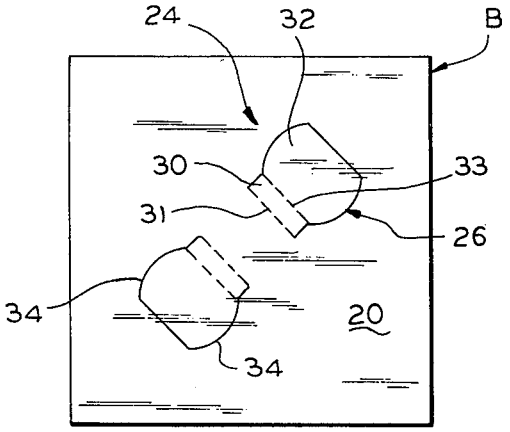
FIG. 5 is a plan view of the blank of sheet material from which the retaining pad shown in the other views may be formed.
Figure 2:
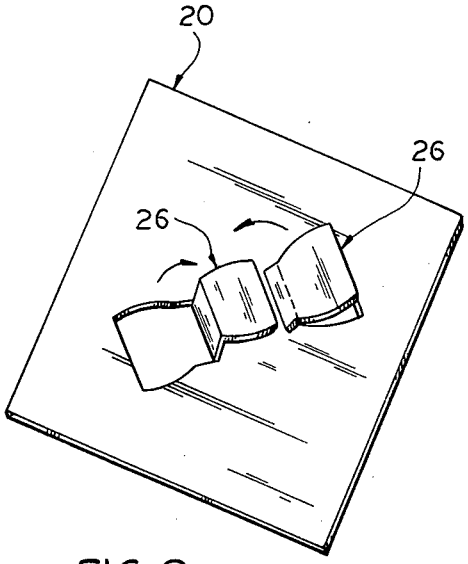
FIG. 2 is a perspective view of a retaining pad of the type shown in FIG. 1.
Figure 3:
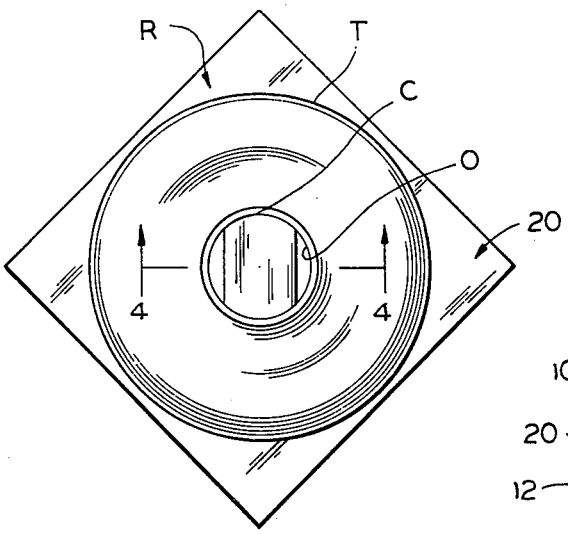
FIG. 3 is a plan view of a retaining pad with the packaged article shown in retained position on the pad.

The reels are separated from each other by a plurality of retaining pads, indicated generally at 20, each of which may be formed from a unitary blank B of paperboard illustrated in FIG. 5 of the drawings.

As best seen in FIG. 1, the lateral dimensions or diameters of the reels are slightly less than the interior lateral dimensions of outer container 12; whereas the lateral dimensions of the pads 20 are substantially the same as those of the container 10. Thus when the reels are secured to the pads in a manner hereinafter described, the reels are prevented from shifting laterally within the container and are prevented from coming in contact with the side walls of the container so as to minimize any possibility of damage to the reels or the product contained thereon.

In order to provide a positive means of securing each of the pads 20 to an adjacent reel 12, the pads are provided with a novel retaining means, the structure of which is hereinafter described.

Figure 4:
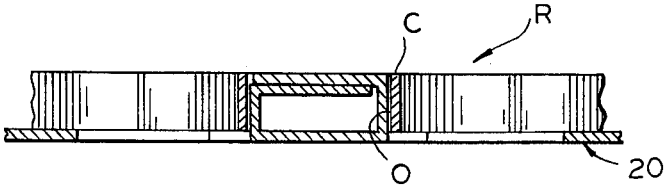
FIG. 4 is a fragmentary, transverse, vertical section taken on line 4—4 of FIG. 3.

Each of the pads 20 comprises a preferably rectangular, although for certain types of packages it could have some other configuration, relatively thin, flat base panel 22, having formed intergrally therewith and projecting therefrom a retaining member 24, which includes a pair of similar retaining elements 26 cut from and formed of the material of base panel 22. As best seen in FIGS. 4 and 5, each of the retaining elements 26 includes a preferably rectangular first section 30, foldably joined along one side edge to the base panel along fold line 31 and having foldably joined to its opposed side edge along wall line 33 a second section 32 which is preferably provided with curved side edges 34.

Still referring to FIG. 4, it will be seen that the retaining member 24 is formed by the pair of cooperating retaining elements 26. First section 30 is folded upwardly from and substantially normal to base panel 24, and second section 32 is folded inwardly approximately normal to first section 30, with respective second sections 32 of each pair of elements disposed in overlapping relationship. Because of their curved side edges, when a reel R is placed over its related retaining pad, the curved side edges of the overlapped second sections 32 of the elements snugly engaged the inner surface of core R within the opening O and provide a tight fit which prevents the lateral shifting of the reel R on the pad 20.

Thus, it will be appreciated that the invention provides a relatively simple and inexpensive retaining means for protection of the articles enclosed within the outer container 10.

I claim:

1. A package for holding a plurality of aligned articles having central openings and which are arranged in a stack or row, comprising, in combination:

a. an outer container having side walls and end walls foldably joined to each other to form a boxlike structure having a cross section of greater lateral dimensions than those of the articles to be contained therein;

b. retaining pads positioned adjacent respective articles;

c. each of said retaining pads including a relatively flat base panel having lateral dimensions which are substantially the same as the interior lateral dimensions of said outer container and the exterior lateral dimension of said article and having cut from material within said base panel thereof and foldably joined thereto a pair of retaining member elements;

d. said retaining member elements being spaced from each other while in the unfolded condition and each element including a first section, having a width approximately equal to the thickness of an adjacent article and folded approximately normal to the plane of said panel, and a second section, folded inwardly from and approximately normal to said first section;

e. the second sections of each retaining member being overlapped one over the other with side edges contoured to be received snugly within the central opening of said adjacent article so that when assembled the elements form a retaining member for preventing lateral movement of said article on said pad in said outer container.

* * * * *